United States Patent [19]

Risch

[11] 4,041,832

[45] Aug. 16, 1977

[54] TUNING AIDS

[76] Inventor: Douglas M. Risch, 816 E. 58th St., Loveland, Colo. 80537

[21] Appl. No.: 635,372

[22] Filed: Nov. 25, 1975

[51] Int. Cl.[2] ..... G10G 7/02

[52] U.S. Cl. ..... 84/454; 324/79 R

[58] Field of Search ..... 84/1.01, 454, 444; 324/79 R, 79 D, 81; 331/111

[56] References Cited

U.S. PATENT DOCUMENTS

| | | | |
|---|---|---|---|
| 3,509,454 | 4/1970 | Gossel | 84/454 X |
| 3,861,266 | 1/1975 | Whitaker | 84/454 |
| 3,879,684 | 4/1975 | Sanderson | 331/111 |
| 3,901,120 | 8/1975 | Youngquist | 84/454 |

FOREIGN PATENT DOCUMENTS

| | | | |
|---|---|---|---|
| 2,322,295 | 11/1973 | Germany | 84/454 |

*Primary Examiner*—Ulysses Weldon

*Attorney, Agent, or Firm*—Hugh H. Drake

[57] ABSTRACT

A musical instrument tuning aid includes a stable source of reference signals. Those signals are divided by a selected amount to produce a given tone signal. A note produced by an instrument under test or measurement is detected and used to develop a corresponding sensed signal. Variations in phase between successive time increments of the sensed signal desirably are averaged so as to produce a measurement signal. The sensed or measurement signal is compared in frequency with the tone signal for the purpose of producing an indication signal. In response to that comparison, a display indicates whether the instrument is sharp, flat, or on-tune. A signal presence detector may be included for the purpose of disabling the display in the absence of a signal to be tested. Also preferably included is an arrangement for causing the on-tune display to flicker at a rate representative of the nearness to an exact match.

5 Claims, 9 Drawing Figures

TUNING AIDS

The present invention pertains to tuning aids. More particularly, it relates to digitally-operated devices which enable the user readily to bring a musical instrument into proper tune.

Using but a single tone from a reference source, such as a pitchpipe, a person with sufficient talent and skill can achieve reasonably accurate tuning of a musical instrument throughout its range of different possible tones. In some cases, greater precision suggests the use of more accurate reference sources such as tuning forks. With complex instruments, such as a piano which has many strings, the task may be made simpler by utilization of at least a small plurality of different tuning forks or the like.

In a multiply-stringed instrument or the like, the person seeking to tune the instrument in the past has made use of one or more such reference sources and has relied upon a highly-developed sense of hearing and appreciation of what is happening to detect the presence of harmonics, subtones and overtones, as well as beats between different ones of such tones, in order to be able to achieve tuning as to many different notes distributed throughout a wide range of musical scale. While many practitioners have developed an ability for achieving tuning of even the most complex musical instrument by means of such an approach, they have had to rely on substantial talent developed through careful training and experience and have depended upon expert usage, and even the existence of, their auditory human facility.

Recognizing the limitations inherent when reliance is placed upon the human auditory response, and upon the necessity for the development of a talent in the use of such response, the prior art has come forth with attempts to enable tuning of a musical instrument by the use of electronic apparatus. The general approach has been that of detecting and comparing a signal produced by the instrument with a calibrated reference signal selected to have a frequency corresponding with the ultimately desired tone. The instrument is then adjusted until the signal it produces has a frequency which is equal to the frequency of the selected reference signal. Typically, an analog-type meter is employed for the purpose of indicating the degree of correspondence, and the direction of any non-correspondence, between the sensed and the reference signals. That is, the user reads a meter which indicates degree of frequency deviation as between the two signals.

With the development of logic systems in the field of electronics, it was recognized that this form of approach could be beneficially used in connection with the tuning of musical instruments. Thus, it has become known to employ a crystal-controlled oscillator in order to provide an accurate reference signal and to process that reference signal in a digital frequency divider chain in order to achieve the production of a selected reference tone. A signal received from the musical instrument is processed, as by squaring and filtering, and compared with the reference tone for permitting the detection of any difference between the signal under measurement and the reference tone. Lack of coincidence is displayed on an analog type meter. For obtaining the desired readout, it also has been known to employ a bi-directional counter for determining which side of an intermediate value is to be indicated.

Certainly, the implementation of digital electronic systems in an effort to provide means for tuning a musical instrument has been commendable. Reliance upon the acquisition of substantial talent or skill in detecting the relationship between different notes has been minimized. Moreover, it appears that at least theoretically more-accurate tuning can be achieved through the use of such systems (provided, of course, that the selection of the reference tone, to which the instrument is to be compared, is faithfully made in correspondence with proper musical requirements and knowledge).

While the above-described developments in the art have, at least seemingly, enabled the production of apparatus capable of performing the assigned tasks, such apparatus has tended to be rather costly. At least much of it has been both cumberson and fragile. At the same time, the implementation of digital logic circuitry has resulted in a degree of sophistry that may result in improper measurement. That is, minute variations in phase as between successive time-increments of the signal under measurement may be detected by the prior apparatus as actual musical pitch variations. When that happens, of course, an erratic output indication is given. Apart from such details, it has also been noted that tuning aids of the type in question have tended to be available only at rather substantial cost. While such cost might easily be absorbed by a professional engaged in the tuning field, it may become rather exorbitant if viewed by the ultimate user who wishes to tune his own instrument.

At least usually, prior such apparatus includes a read-out indicator that is always energized whenever the tuning aid is turned on. That wastes power when no signal to be tested is present. It also may provide a false indication when a signal under test is too weak to be properly processed. In addition, typical prior apparatus has required use of often costly and fragile analog type indicators in order to provide a representation of degree of nearness to an exact on-tune condition.

It is, therefore, a general object of the present invention to provide a new and improved tuning aid which serves to overcome deficiencies and objections adverted to hereinabove.

Another object of the present invention is to provide a new and improved tuning aid which is capable of being packaged in compact form, utilizing off-the-shelf electronic components, and resulting in a cost at least reasonably attractive to the potential user.

A further object of the present invention is to provide a new and improved tuning aid which simplifies its utilization for its intended purpose.

Still another object of the present invention is to provide a new and improved tuning aid which avoids erroneous response to mere phase variations in a signal being tested.

A still further object of the present invention is to provide a new and improved tuning aid in which a read-out display is disabled whenever a signal to be measured is either absent or too weak for proper response.

Yet another object of the present invention is to provide a new and improved tuning aid in which a digital read-out display is enabled to provide a representation of degree of nearness to an exact on-tune condition.

A tuning aid constructed in accordance with the present invention includes a stable source of reference signal having a predetermined frequency. A divider coupled to that stable source divides the frequency of the reference signal by a selected amount so as to produce a given tone signal. Of course, the aid includes means for sensing a note developed by an instrument and developing a corresponding sensed signal. In accordance with one feature, variations in phase between successive time increments of the sensed signal are averaged for the purpose of providing a measurement signal. The aforesaid tone and measurement signals are compared in order to produce an indication signal. That indication signal is responded to for depicting the relationship between the tone and measurement signals. Preferably, the indication signal is employed to digitally display one of the conditions of a sharp, flat or on-tune of the signal under measurement. As another principal feature, a signal presence detector is included to disable the display in the absence of a meaningful sensed signal. A further desirable inclusion is means for effecting flicker of the display at a rate representative of the degree of nearness to an exact match between the tone signal and the sensed or measurement signal.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
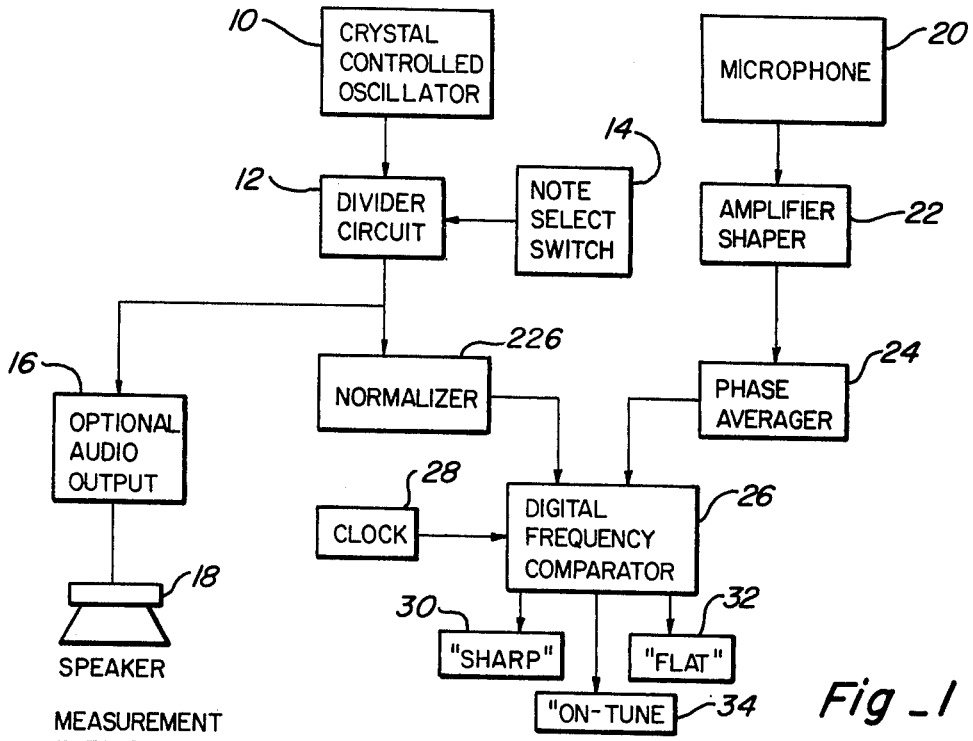
FIG. 1 is a block diagram of one embodiment of a musical instrument tuning aid.
Figure 3A:
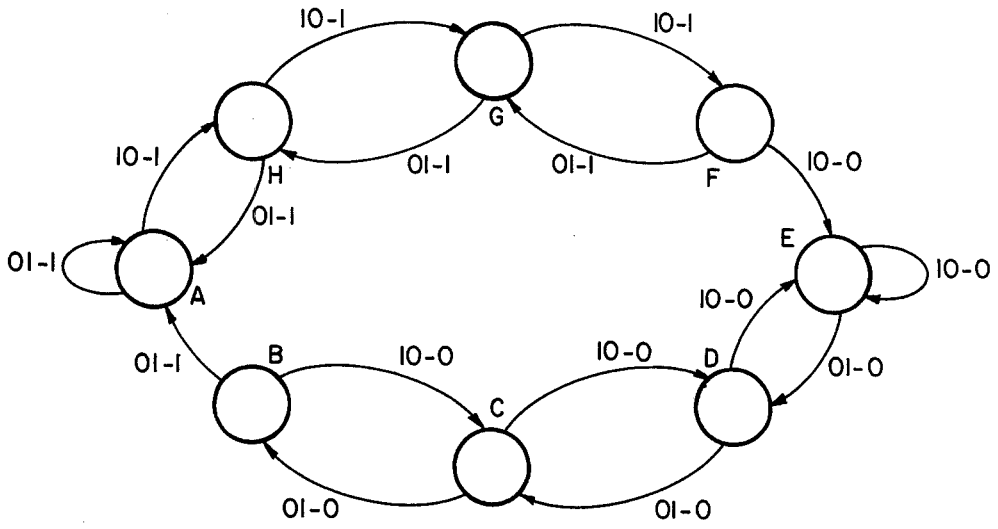
Figure 3B:
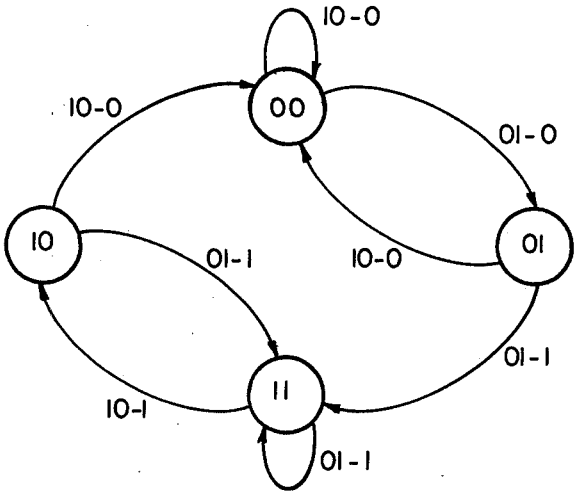
Figure 4:
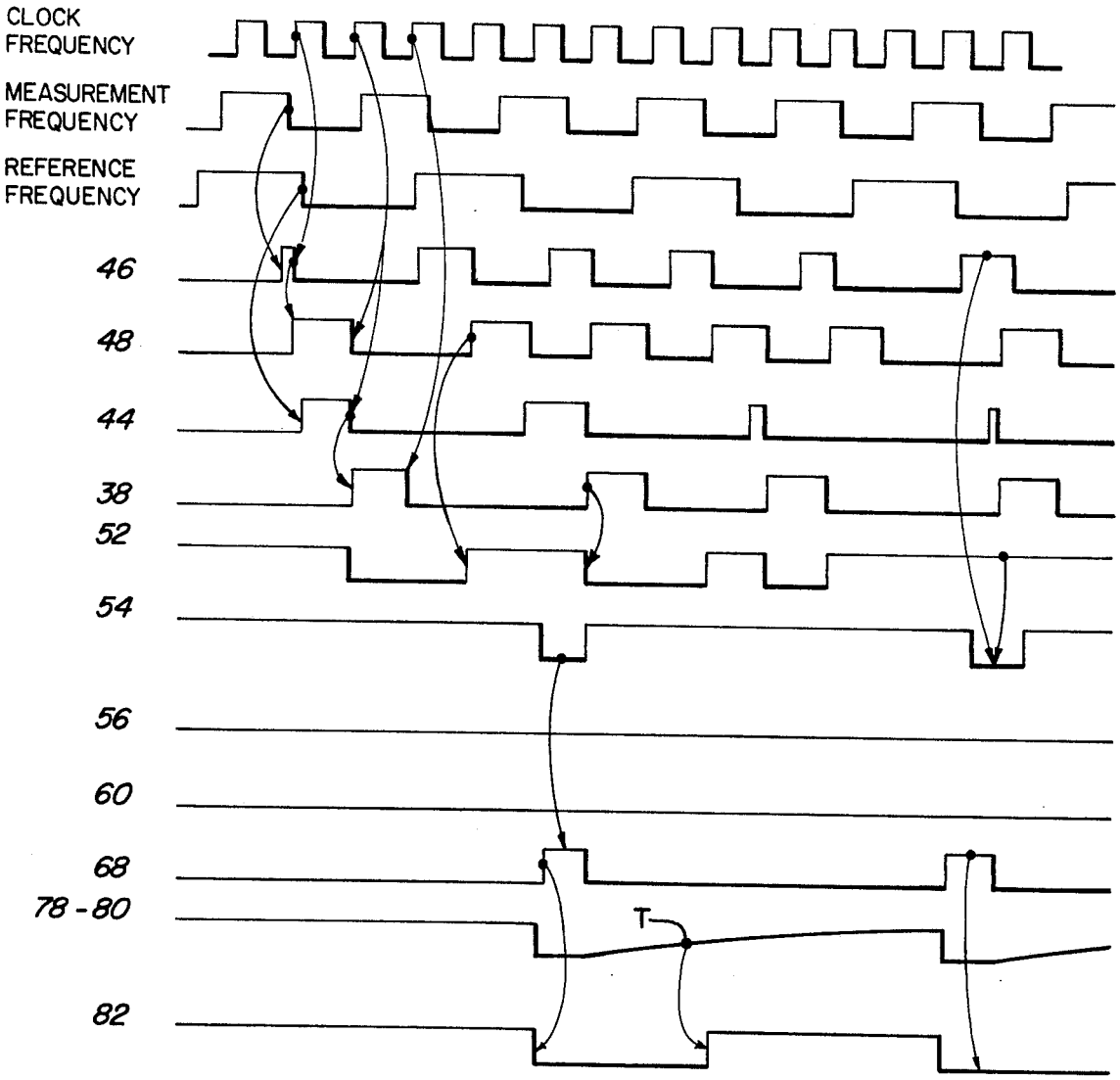
Figure 5:
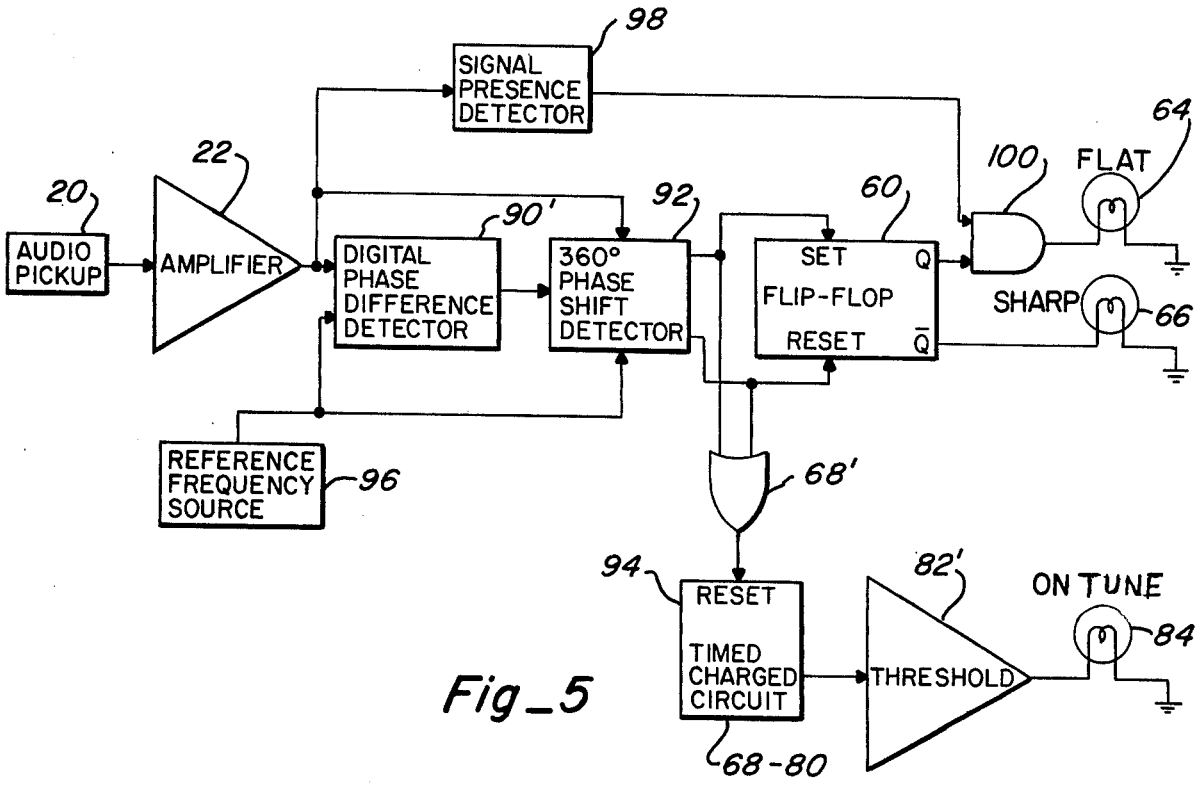
Figure 6:
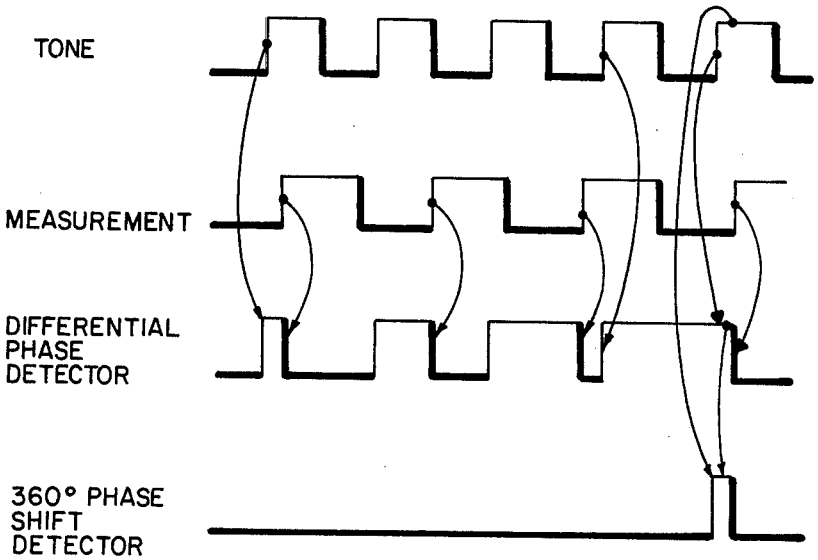
Figure 7:
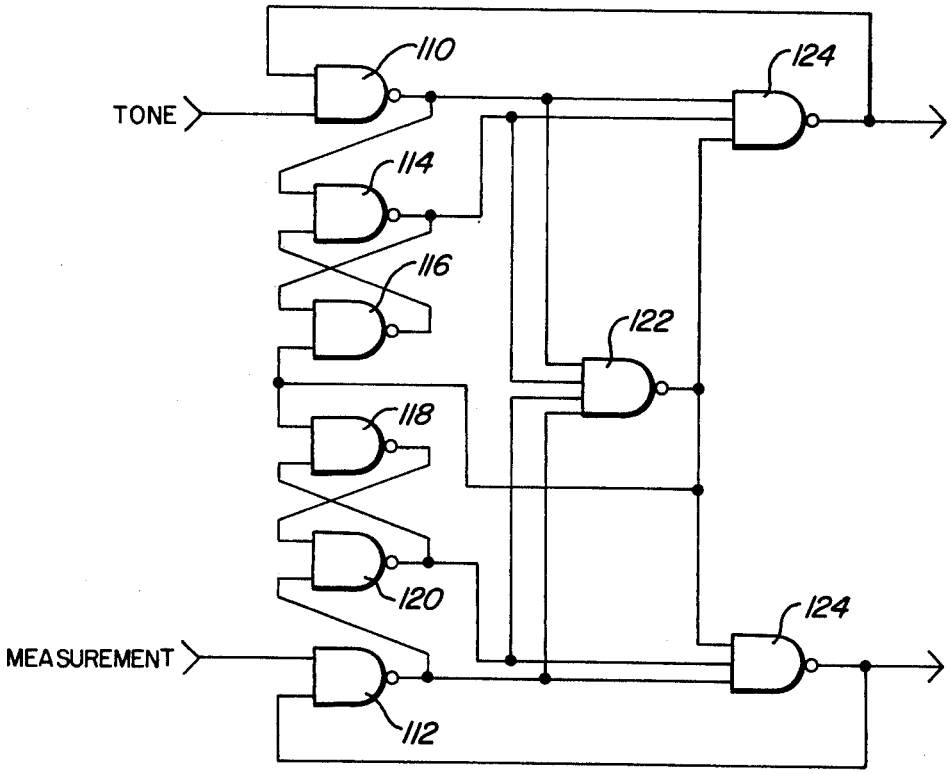

FIG. 3*a* is a general state transistion diagram employed in the logic system of a portion of the system of FIG. 1;

FIG. 3*b* is a simplified version of the state transistion diagram of FIG. 3*a* as actually implemented;

FIG. 4 is a timing diagram of the operation of different ones of the components of the system depicted in FIG. 1;

FIG. 5 is a block diagram of a second embodiment of a musical instrument tuning aid;

FIG. 6 is a timing diagram illustrating the basic operational relationships present in the system of FIG. 5;

FIG. 7 is a schematic diagram of one component shown in FIG. 5; and

Figure 8:
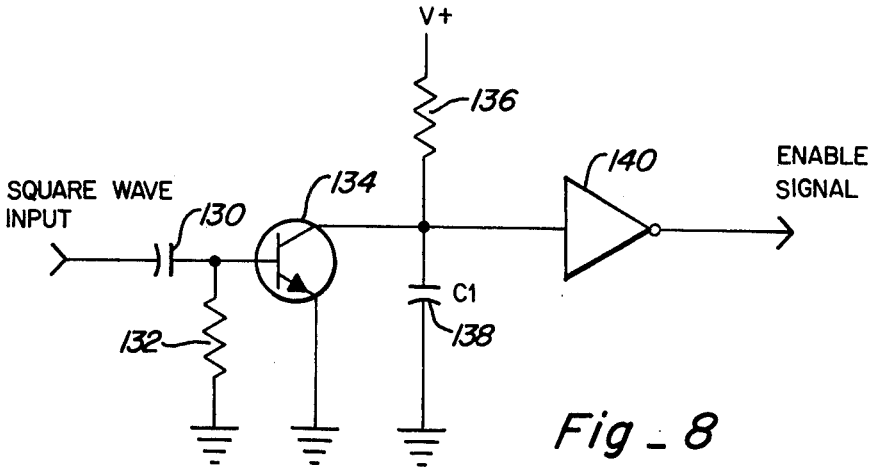

FIG. 8 is a schematic diagram of another component shown in FIG. 5.

At least most always when one deals with electronic logic circuits, it is rather readily recognized by the person skilled in the art that a variety of possible logic-circuit approaches present themselves when attempting to decide on how to proceed from a given set of input information so as to achieve a desired set of output information. As a fundamental example, it is well recognized that at least most circuits which might originally be implemented with the use of AND-gate circuitry could as well have been implemented by the use of NAND-gate circuitry. Thus the following detailed explanation represents only those which are presently preferred embodiments, without limitation upon the numerous obvious variations of digital-logic approach.

In FIG. 1, a crystal-controlled oscillator 10 constitutes a source of reference signal exhibiting substantial stability in frequency and having a predetermined value of that frequency; as herein illustrated, that reference signal frequency is 841,280 hertz. This particular value of the reference frequency is selected for its capability of being divided down in a manner to produce each of the different tones desired for the purpose of tuning a wide-range instrument such as a piano.

Responsive to the reference signal from oscillator 10 is a divider circuit 12 that divides the frequency of the reference signal by a selected amount so as to produce a given tone signal. The amount of division selected at any time is under the control of a note-select switch 14 that governs the operation of divider circuit 12. Of course, the use of a crystal-controlled oscillator in conjunction with an adjustably-divisable divider circuit constitutes that which is well known to the person skilled in the art. The sole purpose of such an arrangement is to produce an output tone signal of the given frequency desired. This scheme, in itself, has often been used in the communication arts for the purpose of selecting a desired local-oscillator frequency in a communications receiver or a radiating frequency in a communications transmitter. The general approach is to start with an oscillator, such as oscillator 10, productive of a frequency above the range intended for use and then selectively to divide down to whatever specific frequency is desired at a given time.

Responsive to the output of divider circuit 12 is an optional audio output circuit 16 that may feed a speaker 18. This enables the user to obtain, if desired, a direct audible production of the reference signal as finally selected with respect to a specific given tone. While the provision of this feature may not be necessary in the ultimate usage of the device, it can at least serve the purpose of enabling the person originally skilled in more fundamental approaches at tuning to verify his own impressions of correct tuning by means of comparing beats and half tones.

At the other side of the system of FIG. 1 is a microphone or audio pickup 20 which senses a note developed by the musical instrument under measurement or test. Thus, microphone 20 develops a sensed signal. Typically, the sensed signal from microphone 20 desirably is amplified so as to be capable of driving subsequent circuitry. At the same time, the implementation of digital logic circuits hereinafter to be described suggests that the signal received from the musical instrument be shaped into a squared waveform that still exhibits the basic cyclic change representative of frequency. Accordingly, microphone 20 feeds an amplifier-shaper 22. The output from amplifier-shaper 22 is an at least substantially-squared wave the cyclic transistion of which represents the frequency of the signal detected by microphone 20. Squaring-type shapers of this kind also are well known to the person skilled in the art.

In producing tones from many musical instruments, successive time-increments of the detected signal under measurement often exhibit minute variations in phase. In a logic system, such phase variations are capable of being interpreted as pitch variations that could cause an erratic determination. To the end of minimizing the effect of such phase variations, the system includes a phase averager 24 responsive to the sensed signal detected by microphone 20 and developed by amplifier-shaper 22. As herein embodied, phase averager 24 is simply a frequency divider that divides the frequency of the signal received from amplifier-shaper 22 by an amount of four. Since the phase variations in the received and processed signal under measurement tend to be equally positive and negative about a zero value, the frequency divider circuit of phase averager 24 serves to reduce the value of such phase excursions at least toward zero.

By operating upon a dividing-down principle, phase averager 24 serves to reduce the logic count of signals in that channel of the apparatus. Compensatorily, a normalizer 226 is included in series with the output of divider circuit 12. Normalizer 226, in this embodiment, divides down by the same amount as is effected by phase averager 24. In a given system, the amount of dividing-down accomplished by normalizer 226 could be incorporated within the function of divider circuit 12.

The processed reference tone and measurement signals are ultimately compared in a digital frequency comparator 26 served by a clock 28 so as to facilitate coherent timing of the comparison operation. Comparator 26 serves to produce an indication signal representing the relationship between the tone and measurement signals ultimately produced at the outputs of normalizer 226 and phase averager 24. The different possible outputs from digital frequency comparator 26 are that of "sharp," "flat" or "on-tune." These outputs preferably are displayed by use of a visual readout such as a light-emitting diode. That is, there is some means responsive to the indicating signal received from comparator 26 such as a sharp display 30, a flat display 32 and an on-tune display 34.

Figure 2:
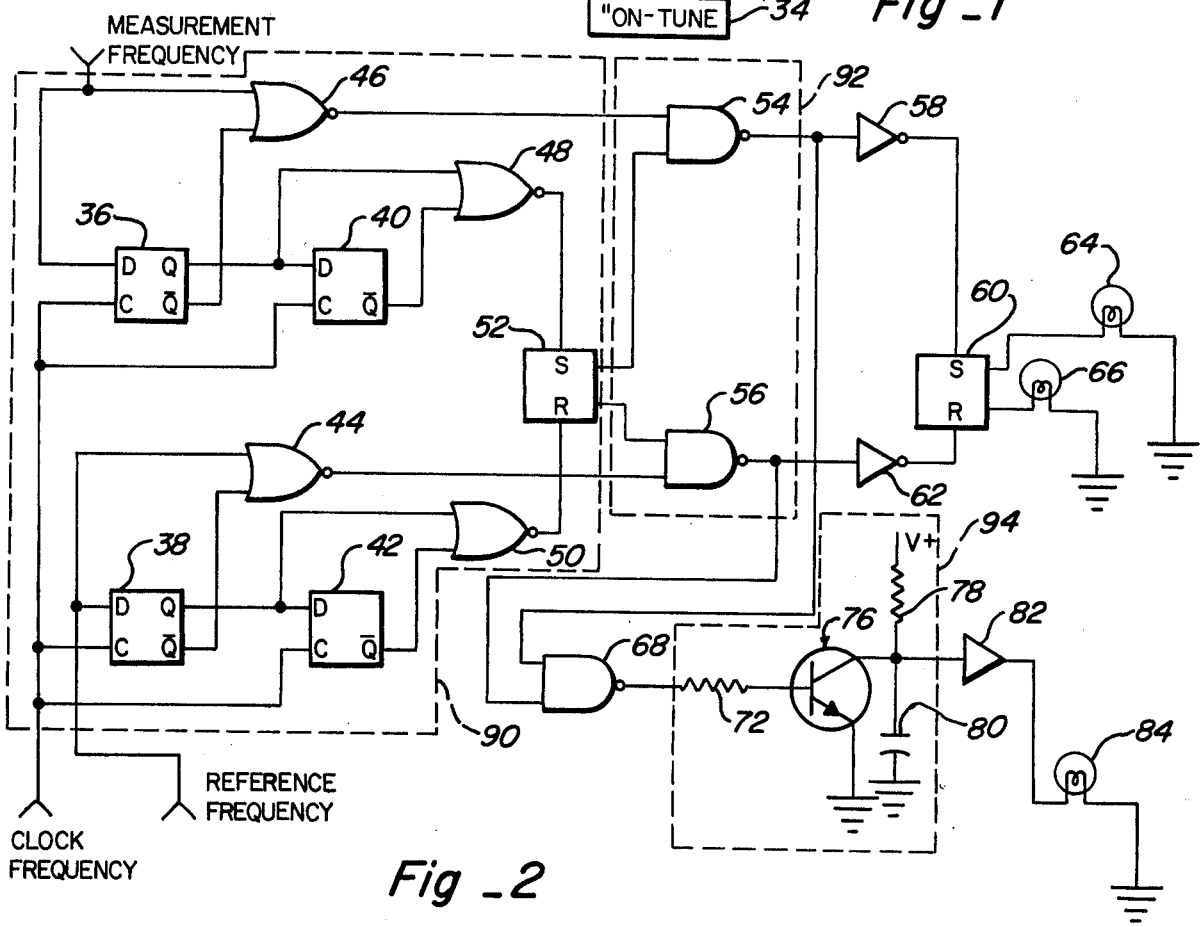
FIG. 2 is a schematic diagram of an implementation of a portion of the system of FIG. 1.

FIG. 2 illustrates a preferred implementation of comparator 26. The clock-frequency from clock 28 is fed to the C input of each of a respective pair of input flip-flops 36 and 38. The clock frequency signal is also fed to the C input of a subsequent pair of flip-flops 40 and 42. The reference tone signal from normalizer 226 is fed to the D input of flip-flop 38 and also to one input of a NOR gate 44. Similarly, the input frequency under measurement, and as derived from amplifier shaper 22 and through phase averager 24, is fed to the D input of flip-flop 36 and also to one input of a NOR gate 46.

The $\overline{Q}$ output of flip-flop 36 is fed to the other input of gate 46, while the similar $\overline{Q}$ output of flip-flop 38 is fed to the other input of gate 44. The Q output from flip-flop 36 is fed to the D input of flip-flop 40, while the similar Q output of flip-flop 38 is fed to the D input of flip-flop 42. From flip-flop 40, the $\overline{Q}$ output is fed as one intput to a NOR gate 48, while the Q output from flip-flop 36 is also fed to the other input of gate 48. Similarly, the $\overline{Q}$ output of flip-flop 42 is fed to a NOR gate 50 the other input of which is fed from the Q output of flip-flop 38.

The output from gate 48 is fed to the set input of a flip-flop 52. Again similarly, the output of gate 50 is fed to the reset input of flip-flop 52. The output from gate 46 is fed as one input to a NAND gate 54, while the similar output from gate 44 is fed to one input of a NAND gate 56. The alternative outputs from flip-flop 52 are fed respectively to the other inputs of gates 54 and 56. The output from gate 54 is fed through a NOT-connective 58 to the set input of a flip-flop 60. Again similarly, the output from gate 56 is fed through a NOT-connective 62 to the reset input of flip-flop 60. The $\overline{Q}$ output from flip-flop 60 energizes a visual indicator 66, such as a light-emitting diode, to represent the sharp condition of the second signal. The $\overline{Q}$ output from flip-flop 60 similarly energizes an indicator 64 such as a light-emitting diode so as to represent a flat condition. The outputs from each of gates 54 and 56 likewise are fed as inputs to a NAND gate 68 the output of which is connected through a resistor 72 to the base of a transistor 76. The collector of transistor 76 is fed to the input of a threshold-setting buffer-amplifier 82. The emitter of transistor 76 is returned to ground. A resistor 78 is connected between a source of operating potential V+ and the collector of transistor 76, while a capacitor 80 shunts that collector to ground. The output of amplifier 82 is fed to another visual display element 84.

The operation of the circuit of FIG. 2 follows the general state transistion diagram depicted in FIG. 3*a,* as will be recognized by the person skilled in the art. Moreover, the specific system illustrated implements the simplified state transistion diagram of FIG. 3*b.* More particularly, the timing diagram of FIG. 4 indicates the governing of the system by the product of the clock and the particular relationship of its operation with respect to a representative set of measured and reference tone frequencies. The different arrows indicate, of course, the transistions which occur.

It will be observed that the system of FIG. 2 includes what is known as an up-down counter. FIGS. 3*a* and 3*b* reveal that comparator 26 is implemented by the use of what is known as an excess false count algorithm. Basically, transistions (either logical 0 to logical 1 or vice versa) of the reference tone frequency and of the measurement frequency are entered into the up-down counter until a net excess of either reference or measurement pulses is detected. When such detection occurs, the sharp or the flat signal is activated. The on-tune condition is met when the up-down counter begins to alternate between a fully saturated state (i.e., all the way up or all the way down) and an intermediate state. When the measured and reference tone frequencies are exactly matched, except for a constant phase angle, the intermediate state will be entered every cycle of the reference tone frequency.

In more detail and with specific reference to FIG. 2, it will be observed that flip-flop 52 serves to remember whether the reference tone or measured frequency was the last to have a 1 to 0 transistion. Whenever two transistions occur on either channel (reference or measured) before the other channel undergoes a transistion, flip-flop 52 allows one of gates 54 or 56 to generate a start or reset pulse for flip-flop 60. That result establishes a sharp output for the case depicted in the state transistions of the diagrams of FIGS. 3*a* and 3*b.* Since gates 54 and 56 generate pulses only when a frequency mismatch exists, the logical OR of those pulses formed by gate 68 will approach zero frequency as the frequencies approach a perfect match. The time constant established by resistor 78 and capacitor 80 serves to set the limit to which the frequencies must match in order that the on-tune condition be met. This is represented by point T, in the diagram of FIG. 4, which indicates the enablement of amplifier 82. For example, if the time constant is 0.1 second, then the frequencies must match to within approximately 10 hertz. The only qualification is that the actual match may be affected by the exact switching thresholds of the different logic circuit components.

As so far described, the system depends on clock 28 for coherent governing of the operation. While this is a desirable feature, it is not necessary to satisfactory performance. Accordingly, clock 28 may be eliminated and the system of FIG. 2 may be simplified in an obvious manner. That manner of simplification is incorporated into the embodiment depicted in FIGS. 5 and 7.

With further reference to FIG. 2, it will be observed that different groups of components have been enclosed by dashed lines to indicate group function. Thus, components 36–52 all constitute that which functions as a digital phase difference detector 90. Gates 54 and 56 combine, with their connections, to serve as a phase shift detector 92. In turn, components 72–80 serve as a time-charge circuit 94.

Turning now to the embodiment of FIG. 5, microphone 20 again feeds amplifier-shaper 22. A reference-frequency source 96 is, as herein exemplified, composed of oscillator 10, divider 12 and switch 14. In the particular arrangement depicted in FIG. 5, phase averager 24 and normalizer 226 have not been shown. When included, phase averager 24 is inserted immediately beyond amplifier-shaper 22, and normalizer 226 is inserted just beyond or included in source 96.

In any case, the measurement signal from amplifier-shaper 22 is fed to an input of a digital phase difference detector 90' as well as to inputs of phase shift detector 92 and a signal presence detector 98. The tone signal from source 96 is fed as an input to both detectors 90' and 92. Detector 90' is the same as detector 90 modified to eliminate provision for the clock signal; a suitable embodiment is shown in FIG. 7. Detector 92 is composed of gates 54 and 56 as shown in FIG. 2. It also receives the tone and measurement signals directly.

The two outputs of detector 92 feed the respective inputs of flip-flop 60 and also the respective inputs of an OR gate 68'. The Q output of flip-flop 60 feeds sharp indicator 66 as before. Output Q of flip-flop 60 feeds flat indicator 64 through an AND gate 100. The output of gate 68' is fed as the reset input to circuit 94'. From the output of the latter, a signal is fed through a lower-threshold-setting buffer-amplifier 82' to indicator 84. The output of detector 98 is fed to the other input of gate 100.

Overall operation of the system of FIG. 5, as well as that of the system of FIG. 1, may be better understood as a result of reading the following discussion. FIG. 6 depicts a typical timing sequence. A cylically varying signal may be expressed:

$$\omega = d\phi/dt, \tag{1}$$

where $\omega$ is the cyclic frequency, $\phi$ is the phase and $t$ is time. At the output of detector 90', the frequency difference is $$\Delta\omega = \omega_t - \omega_m, \tag{2}$$

where $\omega_t$ is the frequency of the tone signal from source 96 and $\omega_m$ is the frequency of the measurement signal from amplifier 22. When the output from detector 90' is constant, $$\Delta\omega = d\phi/dt = d/dt\,[k] = 0, \tag{3}$$

where $k$ is a constant.

When, however, the frequency difference is other than zero, the output from detector 90' is not a constant. Determination of $d\phi/dt$ is then made by choosing a convenient integral shift angle. To that end, detector 92 is utilized. Its 360° phase shift detection enables it to produce a pulse every time the phase difference between the tone and measurement signals exceeds the value of 360°. Moreover, it provides separate outputs respectively for a +360° and a −360° shift. Those separate outputs respectively are fed to the set and reset inputs of flip-flop 60. Through action of the latter, they cause energization of the corresponding ones of indicators 64 or 66.

Detector 98, in a well known manner as such and a suitable form of which is shown in FIG. 8, latches on to the rising edge of the squared measurement signal. Acting through gate 100, it disables energization of "flat" indicator 64 in the absence of any measurement signal at all or whenever the level of that signal is too weak to insure accurate processing of such signal by the system. In the absence of a measurement signal, detectors 90' and 92 normally produce an indicating signal representing the flat condition. This arrangement allows the person using the device to determine if he is actuating the instrument under test sufficiently strong to achieve proper measurement. It also saves power when the device is idle but turned on.

When $\Delta\omega$ is other than exactly zero, a reset pulse is periodically generated and fed to circuit 94 from detector 92 through gate 68'. That pulse causes the output of circuit 94 to have a voltage value below that of the threshold established by buffer 82'. Thus, on-tune indicator 84 is turned off until such time as circuit 94 can bring the indicator-driving voltage back above the threshold valve. As a result, indicator 84 flickers at a rate proportional to the difference in the frequency between the tone and measurement signals.

During any time that the frequency difference is such that its period is less than the time required for circuit 94 to charge to the threshold valve, indicator 84 is maintained in the "off" condition. On the other hand, an exact match of the input frequencies results in indicator 84 being fully "on" without any flicker. Thus, the system provides a simple and easily interpreted visual indication of whether the instrument being tuned is either sharp or flat and, if one of those, providing a further, and gradually-changing, indication as the instrument is tuned of the degree of nearness to a perfect match between the reference tone and sensed measurement signals.

Non-clocked digital phase detectors are now well known in the art. An example of circuitry suitable for detector 90' is shown in FIG. 7. The tone and measurement signals are fed to respective inputs of NAND gates 110 and 112 that are combined with corresponding cross-coupled NAND gates 114, 116 and 118, 120 all interconnected with a supervisory NAND gate 122 and corresponding control NAND gates 124 and 126 so as to provide phase-differential outputs as indicated.

Analogously, signal presence detector 98 may take various forms. A preferred detailed embodiment is shown in FIG. 8. Thus, the squared input wave of the sensed or measurement signal are fed through a capacitor 130 and over a resistor 132 to the base of a transistor 134 the emitter of which is returned to common. Its collector is connected to the junction between a resistor 136 extending from a source of potential V+ and a capacitor 138 returned to common. From that junction, the signal is fed through a NOT-connective 140 that serves as a threshold gate.

When the square-wave signal applied to the input of detector 98 is of sufficiently high frequency, transistor 134 discharges capacitor 138 at a rate such that current through resistor 136 cannot charge that capacitor to the threshold value of gate 140. Thus, gate 140 provides at its output a logical 1 when the input frequency is greater than the time constant of resistor 136 and capacitor 138. Otherwise, the output is a fluctuating value of decreasing duty cycle as the input frequency decreases.

Broadly speaking, it will be seen that the approach hereinabove described permits the achievement of the availability of tuning apparatus that may provide a dependable output indication regardless of phase variations in the signal being measured. Useful other improvements include the display disablement in the absence of a signal and the flicker indication of nearness to an on-tune condition. It also is attractive in providing a direct-type readout. At the same time, the specific implementation of the system involves the use of what amount to off-the-shelf components in those portions of the implementation that utilize a logic approach. Moreover, those components are capable of being entirely mounted upon a single substrate or even integrated into a single chip. The end result is an apparatus that may be exceedingly compact and very conveniently transported and used. It is a simple apparatus capable of being hand-held and yet fully utilizable by those who do not have an ear trained in note production.

While particular embodiments of the invention have been shown and described, and other modifications have been mentioned, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A tuning aid comprising:

a stable source of reference signal having a selectable frequency to produce a given digital tone signal;

means for sensing a note developed by an instrument and developing a corresponding digital measurement signal;

means for comparing said tone and measurement signals to produce indicating signals representing respectively the one present of the conditions of sharp, flat or on-tune of said measurement signal relative to said tone signal, said comparing means having a phase difference detector responsive to said tone and measurement signals for producing a difference signal and a single phase shift detector responsive to said tone and measurement signals and also to said difference signal for producing a first indication signal representing said sharp condition, a second indication signal representing said flat condition and a combination of said first and second signals representing said on-tune condition;

and means responsive to said indicating signals for displaying the respective one of said conditions indicated, said responsive means including first, second and third display elements individually energized in response to respective different ones of said indicating signals and each displaying a single, fixed, stationary and continuous indication of the respective one of the conditions to be indicated.

2. A tuning aid as defined in claim 1 which further includes means for effecting flicker of said third display element at a rate representative of the degree of nearness to an exact match between said tone signal and said measurement signal.

3. A tuning aid as defined in claim 2 in which said flicker means includes a time-charge circuit for energizing said third display element in said responsive means and which further includes a generator of pulses to reset said time-charge circuit at a rate proportional to said degree of nearness.

4. A tuning aid as defined in claim 1 in which said phase shift detector directly develops said first and second indicating signals acted upon by said responsive means for displaying the present one of said sharp or flat conditions, and in which said combination of said first and second signals constitutes another indicating signal acted upon by said responsive means for displaying nearness to an exact match between said tone signal and said measurement signal.

5. A tuning aid as defined in claim 1 which further includes means coupled to said sensing means and responsive to said note sensed for disabling said responsive means in the absence of meaningful existence of said note sensed, in which said phase shift detector normally produces an indicating signal representing said flat condition in the absence of said measurement signal, and in which said disabling means effectively deactivates display by said responsive means of such flat condition.

* * * * *